US006296441B1

(12) United States Patent
Gozdawa

(10) Patent No.: US 6,296,441 B1
(45) Date of Patent: Oct. 2, 2001

(54) COMPRESSORS

(75) Inventor: Richard Julius Gozdawa, Uxbridge (GB)

(73) Assignee: Corac Group PLC, Uxbridge (GB)

( * ) Notice: Subject to any disclaimer, the term of this patent is extended or adjusted under 35 U.S.C. 154(b) by 0 days.

(21) Appl. No.: 09/128,377

(22) Filed: Aug. 3, 1998

Related U.S. Application Data

(63) Continuation-in-part of application No. 09/117,648, filed as application No. PCT/GB97/00292 on Jan. 31, 1997.

(30) Foreign Application Priority Data

Aug. 5, 1997 (GB) ..... 9716494

(51) Int. Cl.[7] ..... F01D 25/08
(52) U.S. Cl. ..... 415/180; 416/204 R
(58) Field of Search ..... 417/423.8, 423.12, 417/423.13, 365, 407; 415/174.5, 112, 175, 177, 179, 178, 180

(56) References Cited

U.S. PATENT DOCUMENTS

| | | | | |
|---|---|---|---|---|
| 1,653,217 | | 12/1927 | Koch . | |
| 1,820,725 | | 8/1931 | Bailey . | |
| 2,073,605 | | 3/1937 | Belluzzo . | |
| 2,173,489 | * | 9/1939 | Voigt | 415/180 X |
| 2,888,193 | | 5/1959 | Greenwald . | |
| 2,969,908 | | 1/1961 | Dallenbach . | |
| 3,090,544 | * | 5/1963 | Wollenweber, Jr. et al. | 415/111 X |
| 3,133,693 | | 5/1964 | Holl . | |
| 3,149,819 | * | 9/1964 | Baumann et al. | 415/180 X |
| 3,179,328 | * | 4/1965 | Pouit | 415/112 X |
| 3,280,750 | | 10/1966 | White . | |
| 3,355,883 | | 12/1967 | Beam, Jr. . | |
| 3,413,925 | * | 12/1968 | Campolong | 415/112 X |
| 3,420,434 | * | 1/1969 | Swearingen | 415/112 |

(List continued on next page.)

FOREIGN PATENT DOCUMENTS

| | | |
|---|---|---|
| 0 402 095 A | 12/1990 | (EP) . |
| 0 420 786 A1 | 4/1991 | (EP) . |
| 1 352 260 A | 1/1964 | (FR) . |
| WO 95/24563 | 9/1995 | (WO) . |
| WO 97/28372 | 8/1997 | (WO) . |

OTHER PUBLICATIONS

Brown Boveri Mitteilungen, vol. 51, No. 12, Dec. 1964, pp. 830–831, XP002031703, "Anwendung Der Gasdynamischen Lager IM Thermischen Turbomaschinenbau", No translation.

*Primary Examiner*—John E. Ryznic
(74) *Attorney, Agent, or Firm*—Christie, Parker & Hale, LLP

(57) ABSTRACT

An oil free high speed gas compressor driven by a high frequently electric motor with a soft magnetic armature which holds permanent magnets arranged peripherally and a centrifugal impeller overhung at one or at each end of the shaft of the armature of the motor, wherein the temperature of the armature is held within the characteristic temperature of its permanent magnets by a flow of cooling liquid through a central bore in the armature or by a flow of cooling liquid through a central drilling through a tie-bolt in thermal contact with a bore in the armature.

18 Claims, 4 Drawing Sheets

U.S. PATENT DOCUMENTS

| | | | | |
|---|---|---|---|---|
| 3,500,755 | | 3/1970 | Gibson . | |
| 3,778,194 | * | 12/1973 | Miller et al. | 417/407 |
| 3,933,416 | | 1/1976 | Donelian . | |
| 3,967,915 | | 7/1976 | Litzenberg | 415/209 |
| 4,009,972 | * | 3/1977 | Sarle | 417/407 |
| 4,152,092 | * | 5/1979 | Swearingen | 415/115 X |
| 4,176,519 | * | 12/1979 | Kronogard | 415/214 X |
| 4,541,786 | * | 9/1985 | McLean | 417/407 |
| 4,668,168 | * | 5/1987 | Schilder et al. | 415/88 X |
| 4,707,978 | | 11/1987 | Garcia Cascajosa . | |
| 4,725,196 | * | 2/1988 | Kaneki et al. | 415/112 X |
| 4,725,206 | * | 2/1988 | Glaser et al. | 417/407 |
| 4,784,574 | | 11/1988 | Tsuno et al. . | |
| 4,927,336 | * | 5/1990 | Rossmann et al. | 417/407 |
| 4,990,068 | | 2/1991 | Zhong et al. . | |
| 5,087,170 | | 2/1992 | Kousokabe et al. . | |
| 5,087,176 | * | 2/1992 | Wieland | 417/407 |
| 5,129,795 | | 7/1992 | Hyland | 417/423.12 |
| 5,549,447 | * | 8/1996 | Bevington | 415/115 |
| 5,605,045 | * | 2/1997 | Halimi et al. | 417/407 X |
| 5,639,209 | | 6/1997 | Pollini et al. . | |

* cited by examiner

COMPRESSORS

CROSS-REFERENCE TO RELATED APPLICATIONS

This application is a continuation-in-part of U.S. patent application Ser. No. 09/117,648, filed Aug. 3, 1998, which claims priority of a 371 PCT/GB97/00292, filed Jan. 31, 1997, which claims priority of U.K. Application No. 9602126.6, filed Feb. 2, 1996; this application also claims priority of U.K. Application No. 9716494.1, filed Aug. 5, 1997.

BACKGROUND OF THE INVENTION

This invention relates to compressors of air or other gases and in particular, but not exclusively, relates to compressors for the pharmaceutical and food industries in which compressed gases free from oil are required.

Such a compressor generally comprises a centrifugal impeller overhung at one end or an impeller overhung at each end of the shaft of the armature of a high frequency electric motor. The armature of the motor carries permanent magnets which become ineffective at temperatures above some characteristic value. A major problem in the design of compressors of that type is to arrange cooling so that the magnets are not degraded by a too severe rise in temperature. The problem of cooling is compounded because of the absence of lubricating oil which otherwise would convect away heat from a compressor to its oil cooler.

Two mechanisms of generation of heat have to be regarded. Although in principle no eddy currents are induced in the armature of the motor, in fact some eddy currents exist because of inevitable departures from perfection in the practical application of the electromagnetic principles of the motor. The first mechanism is the generation of heat by these trace eddy currents. The second mechanism is the generation of frictional heat at the journal bearings and at the thrust bearing.

It may seem appropriate to carry away heat from both of these sources by flows of air or of gas derived from the compressor itself. Although that is a feasible method for carrying heat away from the bearings it is found from heat transfer calculations to be inherently inadequate by itself for the cooling of the armature. At the armature the essential requirement is that the temperature of the permanent magnets should not exceed some characteristic value which in turn requires the heat generated by the trace eddy currents to flow from armature to coolant under the limited temperature difference dictated by the limiting temperature of the magnets.

SUMMARY OF THE INVENTION

According to the present invention, a way of satisfying the criterion is by a flow of a suitable cooling liquid, preferably water, through a central bore in the armature.

According to the present invention, there is provided an oil free high speed gas compressor driven by a high frequently electric motor with a soft magnetic armature which holds permanent magnets arranged peripherally and a centrifugal impeller overhung at one or at each end of the shaft of the armature of the motor, wherein the temperature of the armature is held within the characteristic temperature of its permanent magnets by a flow of cooling liquid through a central bore in the armature or by a flow of cooling liquid through a central drilling through a tie-bolt in thermal contact with a bore in the armature.

The liquid should be in direct contact with the surface of the bore or if it passes through a central drilling through a tie-bolt, then it is required that, by shrink fitting or otherwise, there should be intimate thermal contact between the tie-bolt and the bore of the armature. Although it is possible that other liquids may be found to serve the purpose the heat transfer coefficients from solid to liquid possible with water, together with its other heat transfer properties make water the preferred cooling fluid. Water also permits the design of a low cost cooling system.

At the high speeds at which the compressor is designed to run, conventional bearing surfaces can be destroyed in the absence of a liquid lubricant. Journals and bearing pads of ceramic materials are therefore preferably used. The bearings are lubricated by air or by gas and now cooling by air or gas is feasible because the heat is generated by shear in the air or gas itself and in the absence of any heat transfer surface is convected away directly with the flow of lubricating air or gas. To provide adequate cooling of journal bearings and the thrust bearing under all conditions from start to shut down the bearings and thrust are arranged as aerostatic bearings fed from a receiver pressurised by the compressor. Some aerostatic supply of air or gas is maintained as a coolant at speed although the bearings become self generating.

The two sources of generation of heat are effectively isolated because of the low thermal conductivity of the ceramic bearings.

BRIEF DESCRIPTION OF THE DRAWINGS

Embodiments of the invention will now be described, by way of example only, with reference to the accompanying drawings, in which.

DESCRIPTION OF EMBODIMENTS OF THE INVENTION

An embodiment of the invention will firstly be described with reference to FIG. 1 which illustrates a compressor. Item 1 of the figure is a centrifugal impeller, 2 is the armature of a motor, 3 is a tie-bolt which holds together, in compression, the various segments of the rotor, 4 is an axial bore, e.g. a drilling through the tie-bolt for the passage of cooling water, 5 is a ceramic segment of the rotor which provides the journal of one of the bearings, 6 is a ceramic segment providing both the journal of the second bearing and a thrust collar, items 7 are aerostatic journal bearings, items 8 are thrust and surge aerostatic bearings, 9 is a steel washer which distributes the compressive load from a nut 10 over the ceramic segment 5, 11 is the entry for the cooling water and 12 is its outflow. The casing and the other stationary components of the compressor are not shown but they include an air or gas receiver pressurised by the compressor from which the aerostatic bearings draw their air or gas and a primary closed circuit of treated water for the cooling of the armature with an appropriate system for pumping and cooling the primary water by air or by raw water. The tie-bolt may be shrunk onto the bore of the armature.

Figure 1:
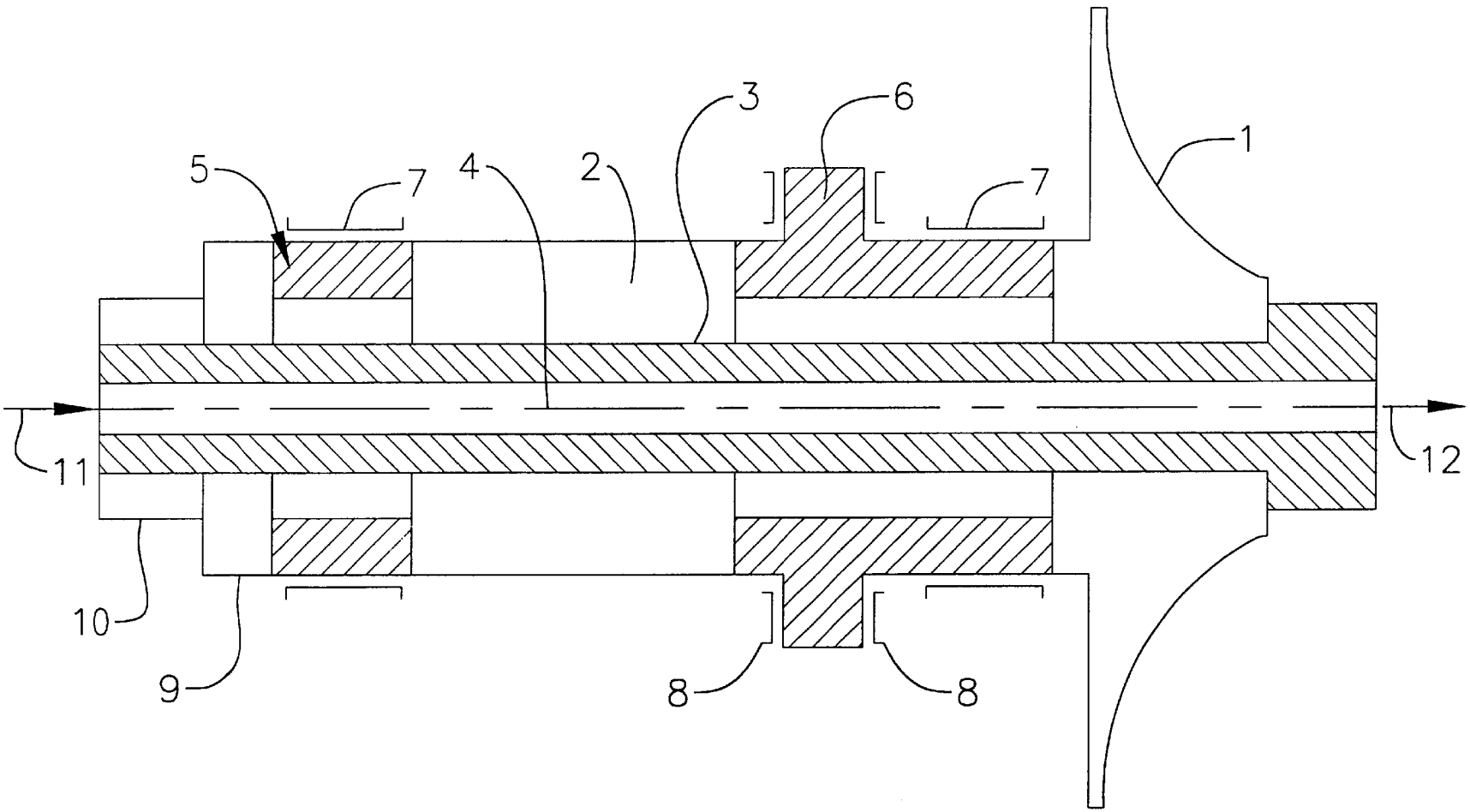
FIG. 1 shows a first embodiment of the invention.
Figure 2:
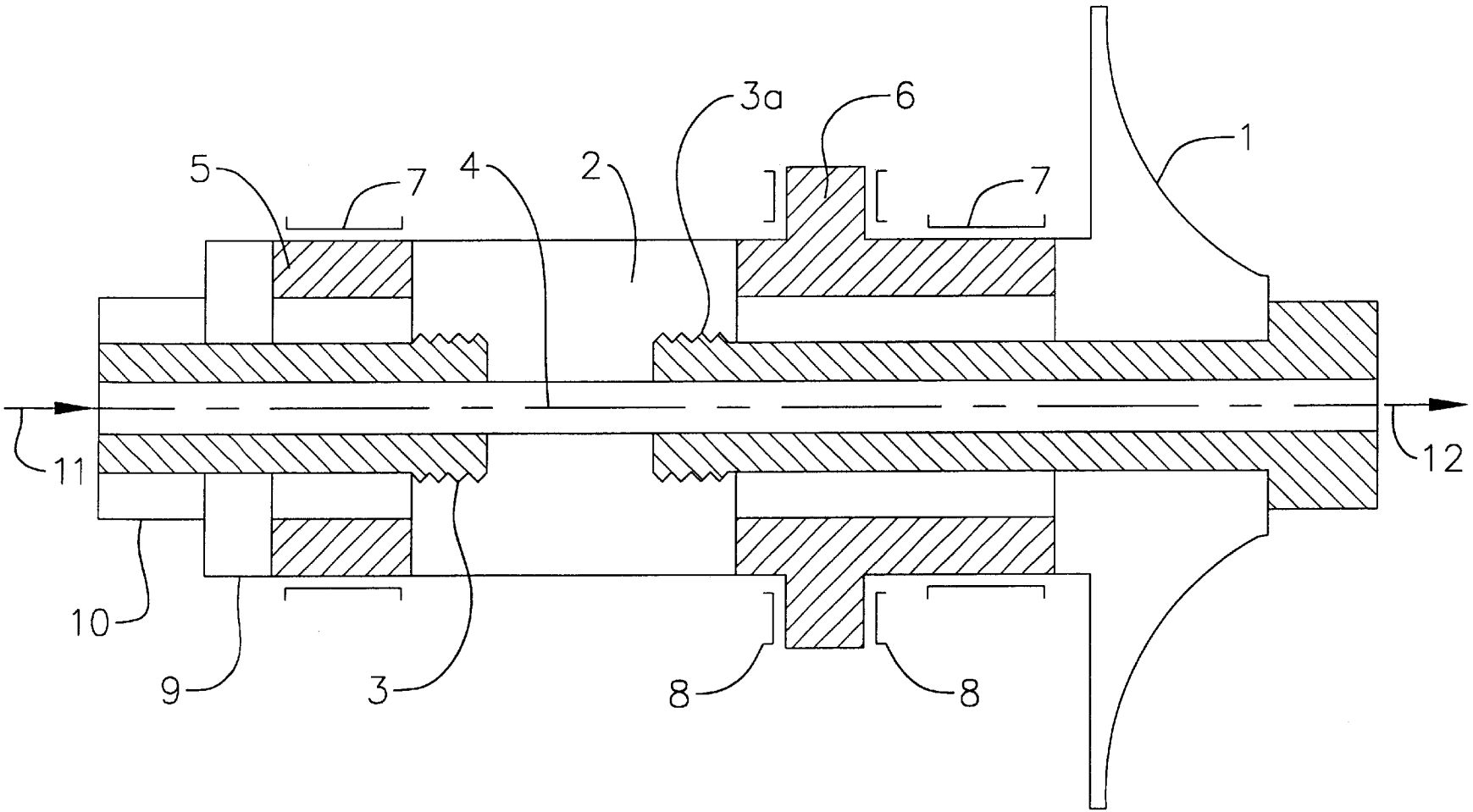
FIG. 2 shows an alternative embodiment of the invention.

FIG. 2 shows an alternative compressor which is similar to that of FIG. 1 except for the tie-bolt 3*a* which is screwed into position.

Means other than shrinking, or screwing, may be used to fit the tie-bolt into intimate thermal contact with the armature, so as to transfer heat to the cooling liquid.

In use, water or other fluid is caused to flow through bore 4 to provide cooling.

Figure 3:
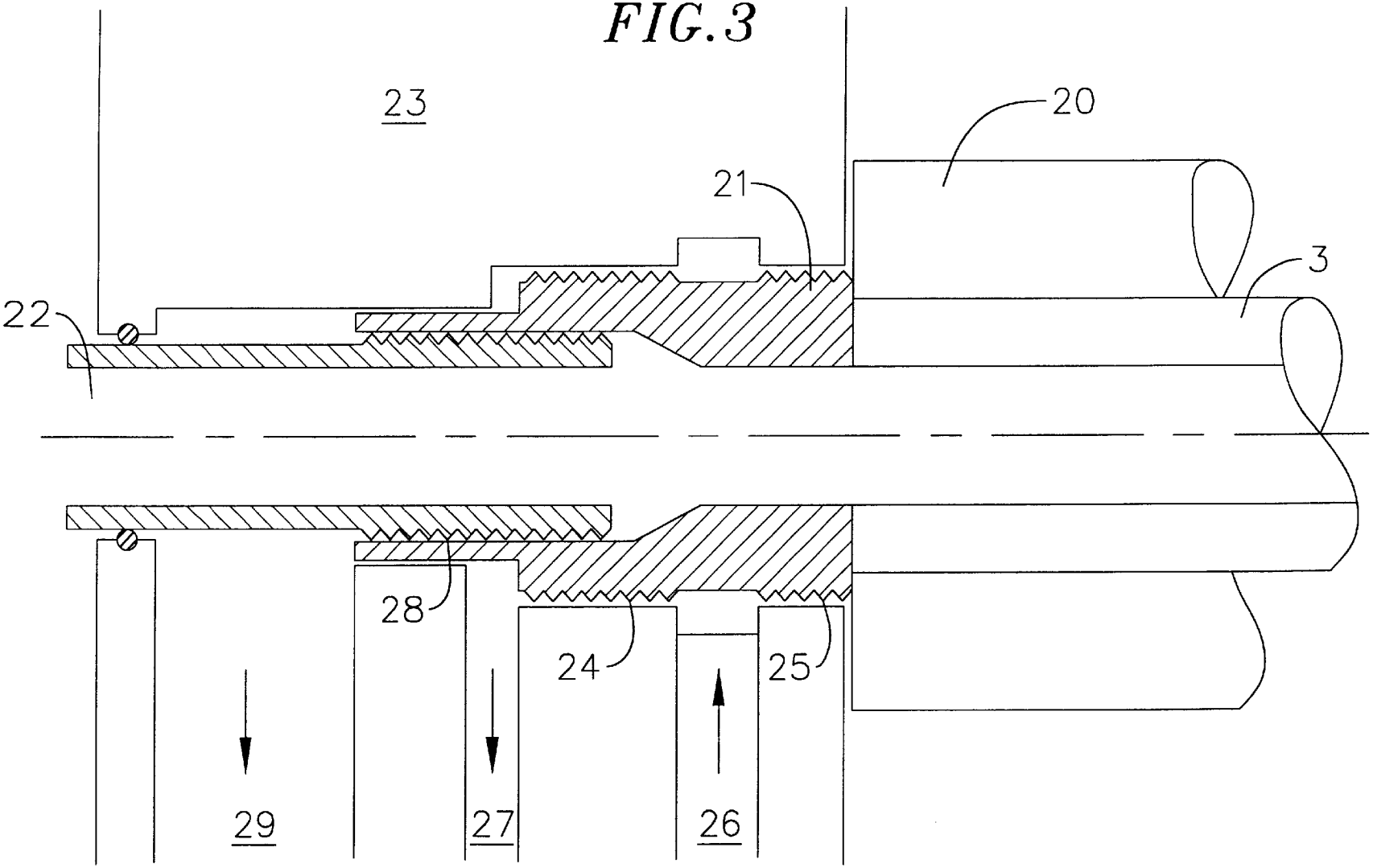
FIG. 3 shows apparatus for feeding cooling fluid into or out of a bore.

Because it is impermissible for any water to enter the flow of air through the compressor the design of the inlet and the outlet for the water has to be given particular care. The means by which water is fed into and from the bore of drilling will be described with reference to FIG. 3 which shows schematically the means of feeding. With reference to the figure, item 20 is one end of the rotor which may be an impeller, 3 is the tie- bolt and 21 is its head or nut. Item 22 is a stationary water inlet nozzle, and 23 is the casing of the compressor. Items 24 and 25 are labyrinth glands with the fins attached to head or nut 21, or attached to the casing or, as is possible should the casing be split, with fins attached to head or nut 21 interleaved with fins attached to the casing. Item 26 is a connection to the receiver and 27 is a drain at ambient pressure. Item 28 is a labyrinth seal which is arranged as one of the three types of seal described above in connection with glands 24 and 25. Item 29 is a drain at ambient pressure.

The principles of operation of the inlet are that labyrinth 28 together with drain 29 provide the primary seal against ingress of water. Then, as a buffer to the ingress into the rotor compartment of seepage along the bores in the casing, pressurised air from the receiver is supplied via inlet 26 to the space between the labyrinth glands 24 and 25. This ensures that leakage into the rotor compartment will be a leakage of air from the receiver, and that any seepage of water will be airborne into drain 27.

A similar water sealing arrangement which may be of identical design is provided at the other end of the rotor for the water outflow.

Water or other fluid cooling may alternatively be applied directly through a central bore in the armature, eg when a tie-bolt is not used.

Figure 4:
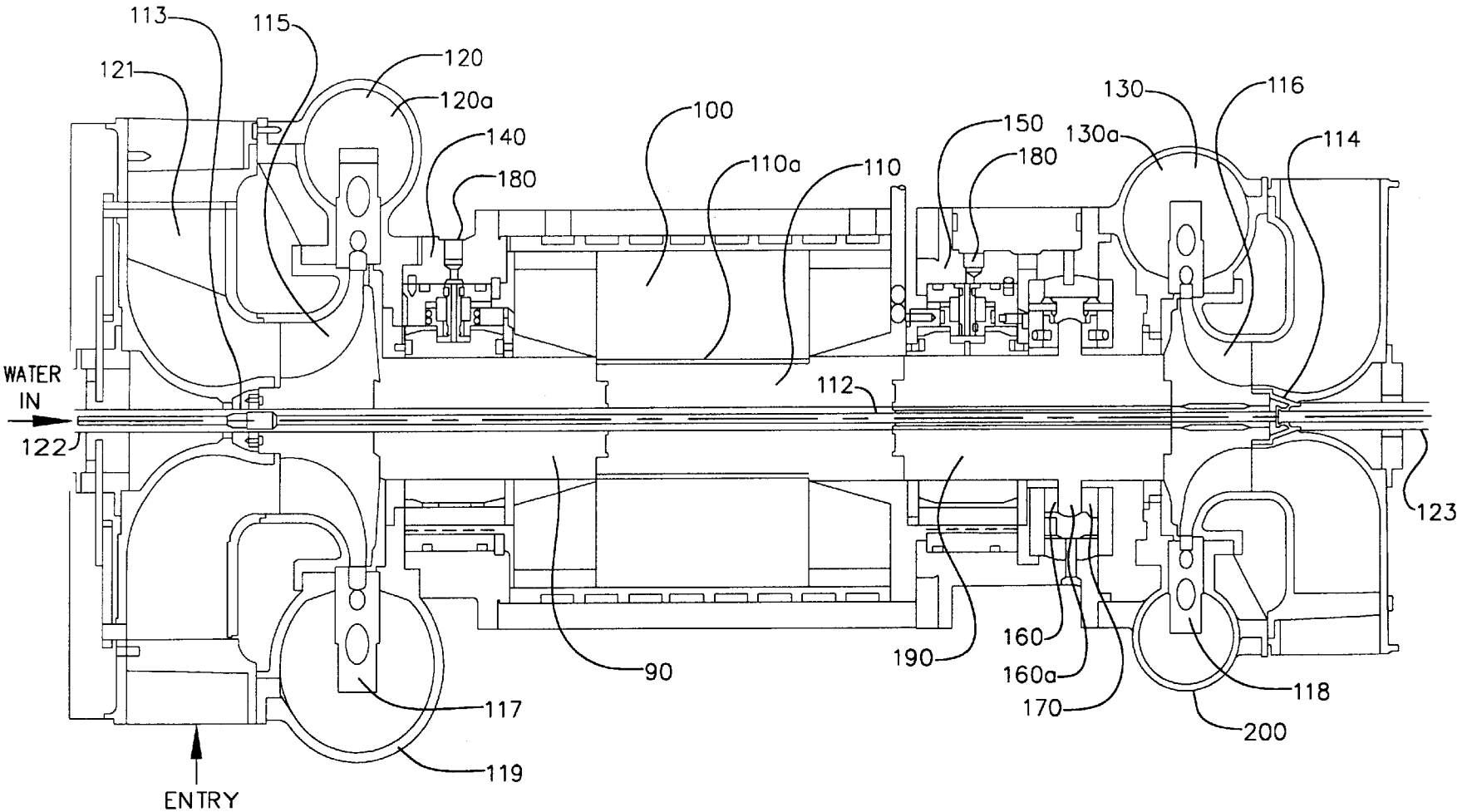
FIG. 4 shows a compressor in more detail.

FIG. 4 shows a compressor in more detail. The compressor shown in the figure is a two-stage turbo-compressor but may of course have more stages than this. It is usual to have two or more stages in a compressor of this type. The compressor is driven directly by a high speed DC motor, shown as stator 100 and rotor 110, which may be arranged to drive at a speed of, say, 50,000–100,000 rpm, although this figure may vary depending on the use required of the compressor.

The motor is controlled by an invertor (not shown) to run directly at the speed required by the compressor and thereby avoid the necessity for a speed-increasing gear box and its associated lubrication system. The motor is used to rotate the rotor 110 in conventional manner. The shaft carries permanent magnets 10*a* which are acted upon by the stator windings. This is connected to two turbo-compressor stages 120 and 130, the motor being positioned between the two compressor stages.

Journal bearings 140, 150 are provided which support the shaft radially. The journal bearings will typically be hydrostatic, gas pressurised, ones with the process air or gas as the supporting medium. Since any compressor takes a finite time to start up the bearings are initially supplied with air or gas from a small accumulator 180 but, once the compressor is up to speed, then the supply is taken direct from the compressor. Many types of bearing may be used successfully with this arrangement. Although the design of the compressor stages 120, 130 is preferably such that any axial thrust is minimised, it will generally be found necessary to include a thrust bearing in the system. In the embodiment shown, this is in the form of a spiral groove thrust bearing 160, 170 which is used to carry any residual axial load. This spiral groove bearing also preferably operates using the process air or gas of the system.

The shaft assembly itself comprises four main hollow components. A central rotor portion 110 lies wholly within the motor stator 100 and carries the permanent magnets 110*a* as described above. At each end of this central portion is a respective one of two end pieces 90, 190 which provide the bearing journals 140, 150 and also a thrust collar 160*a* for the thrust bearings 160, 170. The bearings are mounted outboard of the motor and inboard of the impellers, the thrust bearing being on the portion between the motor and the second impeller stage 130. Each of the outer portions is spigotted to the centre portion and respective impellers 115 and 116 are located by spigots onto the outer portions 90 and 190. Thus, an in-line system results in which central portion 110, outer portions 90, 190 and impellers 115 and 116 all rotate together under the action of motor 100. The assembly is clamped together by means of a hollow tie bolt 112 running axially through their common hollow centres. The tie bolt is hollow to allow for cooling water to be passed through it, and thereby through the centre of the shaft and impeller assembly during operation.

Heat is inevitably generated in the rotor due to eddy current losses in the magnet, particularly at high speed motor operation and the use of coolant water through the central axis of the shaft-impeller assembly provides an effective way of cooling the system. The water is fed in at a non-rotating input 122 which feeds directly into the (rotating) tie bolt 112. To avoid leakage, two respective chambers 113, 114 are provided, one at the eye of each impeller 115, 116. Each has is own labyrinth seal. Water then exits the system at a non-rotating outlet port 123.

During initial start up of the compressor, no water is passed through the shaft which is of course initially cool. At an intermediate speed during acceleration the chambers are pressurised slightly from air/gas compressed by the process. When this pressurisation has been achieved then the water is allowed to flow to begin cooling of the rotor 110 and of the impeller assembly if required.

In the embodiment of FIG. 4 described, two high efficiency centrifugal compressor stages are employed. More than this may be employed in which case more impeller stages will of course be necessary. Each of the stages in the described embodiment comprises a backward sloping impeller 115, 116 followed by a vaned or vaneless diffuser or a pipe diffuser 117, 118 and this is sized to give maximum static pressure recovery before delivery of the air into a low loss scroll 119, 200. The design of impellers, diffusers and scrolls is of course well known.

The air or gas to be processed is arranged to enter the first compressor stage at a direction perpendicular to the machine's axis through a row of variable inlet guide vanes 121. This feature of the gas entering from a direction other than in-line and with variable guide vanes offers a considerable degree of flow control which is not possible with positive displacement type machines. The air or gas is then acted upon by the impeller 115 and leaves this stage at portion 120*a* in the figure to enter an intercooler (not shown). Intercoolers themselves are well known and the intercooler has not been shown for clarity. The air or gas then passes through the intercooler before entering the second impeller stage at 130*a*. The process ensures a low power consumption and reduces the degree of after-cooling which may be required in some applications. The air or gas is enacted upon by the second impeller 116 and allowed to the exit the system in its processed form.

As described, preferably the rotor mechanism (rotors, shaft, etc) is entirely or partially of ceramic. This helps to achieve thermal stability and lightness in the machine.

What is claimed is:

1. A compressor comprising a rotatable shaft, drive means for rotating the shaft, at least one impeller rotor stage mounted on the shaft, and a tie bolt mounted through said at least one impeller rotor stage and through at least part of said shaft to hold said at least one impeller rotor stage to said shaft, said tie bolt having a hollow interior, wherein the rotatable shaft and the at least one impeller rotor stage are hollow and a supply of liquid is provided to flow axially through them, via the hollow interior of said tie bolt, as a coolant liquid.

2. A compressor as claimed in claim 1, wherein the shaft comprises a plurality of hollow sections.

3. A compressor as claimed in claim 2, wherein said hollow tie bolt is mounted through at least one of said plurality of hollow shaft sections.

4. A compressor as claimed in claim 2, wherein at least one of said hollow shaft sections is of ceramic material.

5. A compressor as claimed in claim 2, wherein at least one of said hollow shaft sections is of ceramic material.

6. A compressor as claimed in claim 1, wherein non-rotating coupling means are provided to couple a source of coolant liquid into and out of respective opposite ends of the tie bolt.

7. A compressor as claimed in claim 1, wherein journal and thrust bearings are provided.

8. A method of cooling a rotor of a compressor having a hollow rotatable shaft, drive means for rotating the shaft, at least one hollow impeller rotor stage mounted on the shaft, and a tie bolt mounted through at least part of said shaft and through said at least one impeller rotor stage to hold said at least one impeller rotor stage to said shaft, said tie bolt having a hollow interior, the method comprising providing a supply of coolant liquid and causing said coolant liquid to flow axially through the shaft and said at least one impeller rotor stage, via said hollow interior of said tie bolt, to cool the impeller, the method comprising:

providing a supply of coolant liquid; and causing said coolant liquid to flow axially through the shaft and said at least one impeller rotor stage, via said hollow interior of said tie bolt, to cool the impeller.

9. A method as claimed in claim 8, wherein the cooling liquid is water.

10. A method as claimed in claim 7, wherein coolant liquid is only caused to begin to flow at an intermediate speed during acceleration of the compressor from rest.

11. An oil free high speed gas compressor comprising:

a high frequency electric motor having a soft magnetic armature with permanent magnets arranged and held peripherally thereon, said armature having a central bore formed therein:

a shaft including said armature and having first and second opposite ends;

at least one centrifugal impeller overhung at one of said first and second ends of said shaft; and a tie-bolt in thermal contact with said bore in said armature, said tie bolt having a central bore therethrough, whereby to enable the temperature of the armature to be held within the characteristic temperature of its permanent magnets by a flow of cooling liquid through the central bore formed in the tie bolt.

12. A compressor as claimed in claim 11, wherein said tie-bolt is shrunk into the central bore into the armature to be in intimate thermal contact therewith.

13. A compressor as claimed in claim 11, wherein said shaft further includes a ceramic rotor segment at each end of said armature, one of said ceramic rotor segments providing a journal of a first bearing of said rotor and the other of said ceramic rotor segments providing a journal of a second bearing of said rotor and a thrust collar.

14. A compressor as claimed in claim 13, wherein the bearings are aerostatic bearings for the supply thereto of high pressure gas to enable said bearings, on the run up of the compressor, to operate in aerostatic mode prior to self generation intervening at speed.

15. A compressor as claimed in claim 11, further comprising stationary nozzle means at each end of its rotor for, at said first end, the inlet of cooling liquid into the central bore of the tie-bolt and for, at said second end, the outlet of the cooling liquid.

16. A compressor as claimed in claim 15, further comprising a labyrinth gland at each said nozzle means, between the outer cooperating surface of a nozzle and the inner cooperating surface of a bore in a head or nut of the tie-bolt, and a drain at ambient pressure, to form a primary seal against ingress of water into the rotor space of the casing of the compressor.

17. A compressor as claimed in claim 16, further comprising, at each end of the rotor, a labyrinth gland in two segments separated by a pocket fed with pressurized air or gas from a receiver pressurized by the compressor having, as cooperating surfaces, the outer surface of the head or nut of the tie-bolt and a bore in the casing.

18. A compressor as claimed in claim 17, further comprising, at the outboard end of each of said segmented labyrinth seals, a drain at ambient pressure.

* * * * *